US012391467B2

(12) United States Patent
Conlon et al.

(10) Patent No.: US 12,391,467 B2
(45) Date of Patent: Aug. 19, 2025

(54) MODULAR LOADING SYSTEM FOR A SHIPPING CONTAINER

(71) Applicant: IRON MOUNTAIN INCORPORATED, Boston, MA (US)

(72) Inventors: Richard Conlon, London (GB); Graham McNamara, Cranford, NJ (US); Brent Willson, Price, UT (US); Kevin Murphey, London (GB)

(73) Assignee: Iron Mountain Incorporated, Boston, MA (US)

( * ) Notice: Subject to any disclaimer, the term of this patent is extended or adjusted under 35 U.S.C. 154(b) by 48 days.

(21) Appl. No.: 18/342,242

(22) Filed: Jun. 27, 2023

(65) Prior Publication Data

US 2025/0002246 A1 Jan. 2, 2025

(51) Int. Cl.
*B65D 90/04* (2006.01)
*B65D 90/00* (2006.01)

(52) U.S. Cl.
CPC ..... *B65D 90/041* (2013.01); *B65D 90/0053* (2013.01); *B65D 2590/0041* (2013.01); *B65D 2590/04* (2013.01)

(58) Field of Classification Search
CPC ..... B65D 90/041; B65D 90/0053; B65D 2590/0041; B65D 2590/04; B65D 2590/0066; B65D 2590/005; B65D 88/129; B65D 90/004; B65D 90/0046; B65D 90/006
See application file for complete search history.

(56) References Cited

U.S. PATENT DOCUMENTS 3,114,336 A * 12/1963 Schroeder ..... B60P 7/15 410/149
3,647,080 A * 3/1972 Denny ..... A47B 47/027 108/901
3,963,290 A * 6/1976 Rennemann ..... B65D 90/0053 312/351

(Continued)

FOREIGN PATENT DOCUMENTS

DE 3046250 A1 7/1982
DE 4341230 A1 6/1995

(Continued)

OTHER PUBLICATIONS

Application No. EP24183939.8, Extended European Search Report, Mailed on Nov. 11, 2024, 9 pages.

*Primary Examiner* — Shawn M Braden
(74) *Attorney, Agent, or Firm* — Kilpatrick Townsend & Stockton LLP

(57) ABSTRACT

A modular loading system may include structural beams and modular beams that can be located in a shipping container. The structural beams can be arranged in a first direction, and the modular beams can be arranged in a second direction that is approximately perpendicular to the first direction. The structural beams can include a fixed contact surface and an adjustable contact surface positioned opposite the fixed contact surface for stabilizing the modular loading system in approximately the first direction. The modular beams can include receiving notches sized to receive a locking bar for stabilizing the modular loading system in a third direction that is approximately perpendicular to the first direction and the second direction.

19 Claims, 6 Drawing Sheets

(56) References Cited

U.S. PATENT DOCUMENTS

| | | | | |
|---|---|---|---|---|
| 4,030,611 | A * | 6/1977 | Konstant | A47B 57/485 211/182 |
| 6,726,041 | B2 * | 4/2004 | Dunn | B65D 19/12 206/335 |
| 6,776,298 | B2 * | 8/2004 | Courtwright | B65G 1/026 211/183 |
| 2002/0130099 | A1 | 9/2002 | Rene et al. | |
| 2005/0000834 | A1 * | 1/2005 | Clive-Smith | B65D 88/129 206/335 |
| 2006/0033359 | A1 * | 2/2006 | Taylor | B60P 3/14 296/182.1 |
| 2014/0190964 | A1 | 7/2014 | Skeid | |

FOREIGN PATENT DOCUMENTS

| | | | |
|---|---|---|---|
| DE | 29708856 | U1 | 9/1998 |
| EP | 2933207 | A1 | 10/2015 |
| FR | 2894901 | A1 | 6/2007 |
| FR | 2967982 | A1 | 6/2012 |
| GB | 1504983 | A | 3/1978 |
| GB | 2543044 | A | 4/2017 |
| SE | 387314 | B | 9/1976 |
| WO | 9955601 | A2 | 11/1999 |

* cited by examiner

MODULAR LOADING SYSTEM FOR A SHIPPING CONTAINER

TECHNICAL FIELD

The present disclosure relates generally to containers and, more particularly (although not necessarily exclusively), to modular loading systems for shipping containers.

BACKGROUND

Items, such as artwork, consumer goods, natural resources, and the like, can be produced in various locations throughout the world. In some instances, an end user may in a first location may desire a first item that is produced or otherwise positioned in a second location that may be far away (e.g., tens of miles, hundreds of miles, thousands of miles, or the like) from the first location. Transporting the item from the second location to the first location without causing damage to the item may be technically challenging. For example, packing the item in a shipping container may cause damage, whether during a packing operation, during transport, and the like, to the item. Additionally, other techniques for transporting the item may produce excessive amounts of carbon emissions that may be harmful to the environment.

SUMMARY

In some embodiments, a modular loading system can include a set of structural beams and a set of modular beams. The set of structural beams can be positioned in a shipping container and can be spaced apart and arranged in a first direction. At least one structural beam of the set of structural beams can include a fixed contact surface and an adjustable contact surface. The fixed contact surface can be located on a first end of the at least one structural beam. The adjustable contact surface can be located on a second end of the at least one structural beam that can be located opposite the first end. The fixed contact surface and the adjustable contact surface can be configured to apply pressure to an inside surface of the shipping container to stabilize the modular loading system in approximately the first direction. The set of modular beams can be spaced apart and arranged in a second direction that is nonparallel to the first direction. Each modular beam of the plurality of modular beams can be coupled with each structural beam of the plurality of structural beams at one or more connection points.

In other embodiments, a system can include a shipping container and a modular loading system that can be positioned in the shipping container and can be removed from the shipping container. The modular loading system can include a set of structural beams and a set of modular beams. The set of structural beams can be positioned in the shipping container and can be spaced apart and arranged in a first direction. At least one structural beam of the set of structural beams can include a fixed contact surface and an adjustable contact surface. The fixed contact surface can be located on a first end of the at least one structural beam. The adjustable contact surface can be located on a second end of the at least one structural beam located opposite the first end. The fixed contact surface and the adjustable contact surface can be configured to apply pressure to an inside surface of the shipping container to stabilize the modular loading system in approximately the first direction. The adjustable contact surface can be used to install the modular loading system in non-uniform spacing of the shipping container to enhance one or more parameters. The set of modular beams can be spaced apart and arranged in a second direction that is nonparallel to the first direction. Each modular beam of the set of modular beams can be coupled with each structural beam of the set of structural beams at one or more connection points. Each modular beam of the plurality of modular beams can include a set of receiving notches. Each receiving notch of the set of receiving notches can be sized to receive a locking bar that can be configured to stabilize the modular loading system in a third direction that is approximately perpendicular to the first direction and the second direction. The locking bar can be repositioned within the modular loading system for enhancing the one or more parameters.

In other embodiments, a system can include a first modular loading system and a second modular loading system. The first modular loading system can include a first set of structural beams and a first set of modular beams. The first set of structural beams can be positioned in a shipping container and can be spaced apart and arranged in a first direction. At least one structural beam of the first set of structural beams can include a first fixed contact surface and a first adjustable contact surface. The first fixed contact surface can be located on a first end of the at least one structural beam of the first set of structural beams. The first adjustable contact surface can be located on a second end of the at least one structural beam located opposite the first end. The first fixed contact surface and the first adjustable contact surface can be configured to apply pressure to an inside surface of the shipping container to stabilize the first modular loading system in approximately the first direction. The first set of modular beams can be spaced apart and arranged in a second direction that is nonparallel to the first direction. Each modular beam of the first set of modular beams can be coupled with each structural beam of the first set of structural beams at one or more connection points. Each modular beam of the first set of modular beams can include a first set of receiving notches. Each receiving notch of the first set of receiving notches can be sized to receive a first locking bar that can be configured to stabilize the first modular loading system in a third direction that is approximately perpendicular to the first direction and the second direction. The second modular loading system can include a second set of structural beams and a second set of modular beams. The second set of structural beams can be positioned in the shipping container and can be spaced apart and arranged in approximately the first direction. At least one structural beam of the second set of structural beams can include a second fixed contact surface and a second adjustable contact surface. The second fixed contact surface can be located on a first end of the at least one structural beam of the second set of structural beams. The second adjustable contact surface can be located on a second end of the at least one structural beam positioned opposite the first end. The second fixed contact surface and the second adjustable contact surface can be configured to apply pressure to the inside surface of the shipping container to stabilize the second modular loading system in approximately the first direction. The second set of modular beams can be spaced apart and arranged in approximately the second direction. Each modular beam of the second set of modular beams can be coupled with each structural beam of the second set of structural beams at one or more connection points. Each modular beam of the second set of modular beams can include a second set of receiving notches. Each receiving notch of the second set of receiving notches can be sized to receive a second locking bar that can be configured to stabilize the second modular loading system in approximately the third direction.

DETAILED DESCRIPTION

Figure 1:
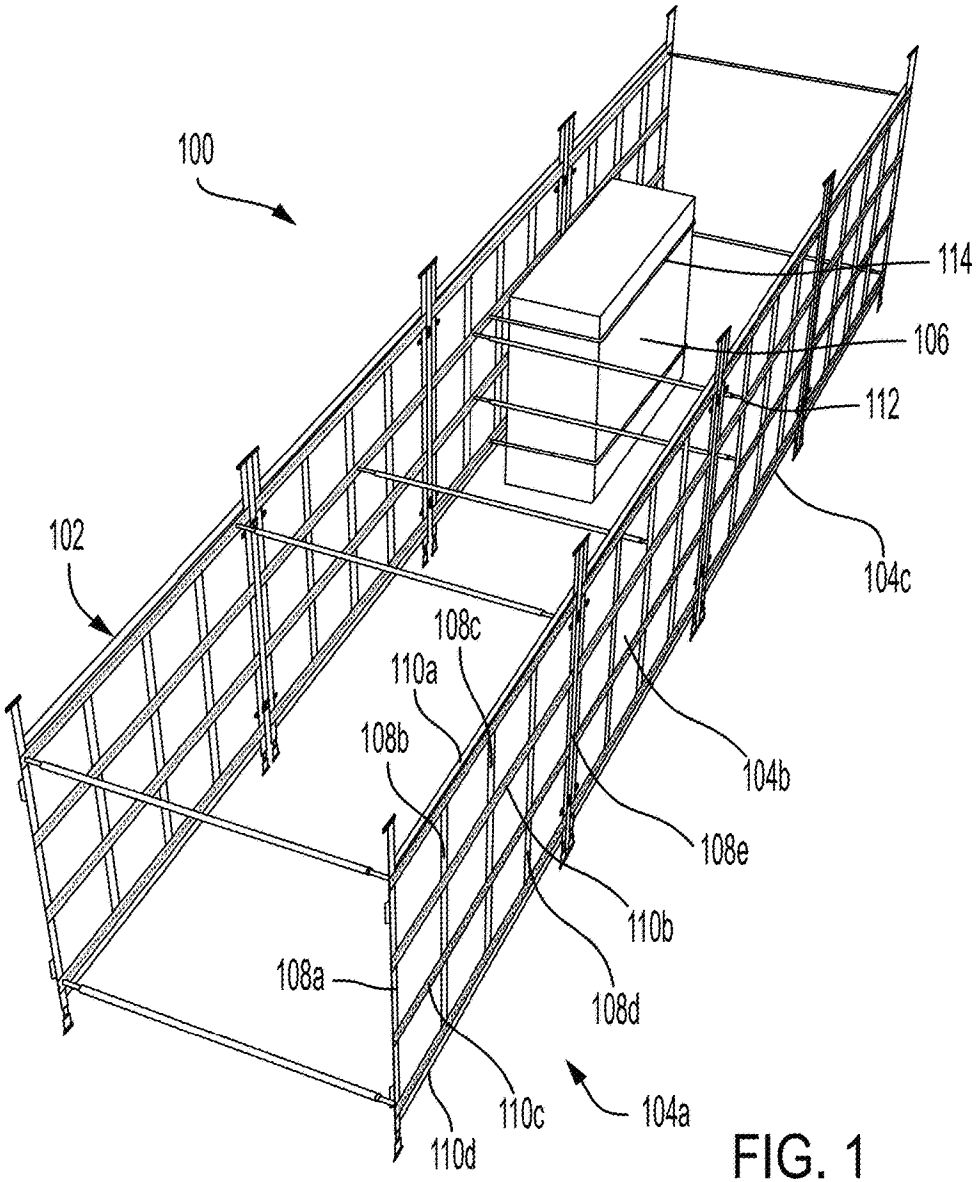
FIG. 1 is a perspective view of an inside of a shipping container with a modular loading system according to one example of the present disclosure.

Certain aspects and examples of the present disclosure relate to a modular loading system for a shipping container. The shipping container may be any size for packing and/or transporting items such as artwork, natural resources, consumer goods, and the like. The shipping container may be transported via water (e.g., using a ship), via air, via land (e.g., using a truck), or the like. In a particular example, the shipping container can be packed or otherwise loaded with items at a port, positioned on a ship, and transported across an ocean or other large body of water to reach a destination with one or more end users of the items. The modular loading system can be positioned in the shipping container to facilitate packing items in the shipping container. The modular loading system may include one or more types of beams or other structural features. For example, the modular loading system can include one or more structural beams, one or more modular beams, and the like. The structural beams can be arranged in a first direction, and the modular beams may be arranged in a second direction that may be nonparallel to the first direction. In some examples, at least one of the structural beams can include a first, fixed contact surface and a second, adjustable contact surface positioned opposite the first, fixed contact surface. Each of the contact surfaces may apply adjustable pressure to an inside of the shipping container to stabilize the modular loading system, or items loaded therein, in approximately the first direction. Additionally, the modular beams may include modular notches that may be sized to receive a locking bar that can stabilize the modular loading system, or items loaded therein, in a third direction that is approximately perpendicular to the first direction and the second direction.

Other shipping containers and loading techniques may cause damage to a unique set of items, may generate excessive carbon emissions, and the like. A unique set of items may have an irregular packing scheme. For example, while some items may be packed and loaded into the shipping container using standard pallets, the unique set of items may be fragile, may be irregularly shaped, or may otherwise be unable to use pallets or other standard packing techniques in shipping containers. Other loading techniques to load the unique items into other shipping containers may involve using lumber or other single-use loading material to pack items in the shipping container. The other loading techniques may waste (i) a considerable amount of space in the shipping container, (ii) a considerable amount of time constructing a custom loading system from the lumber or other single-use loading material, and the like. Wasted space in the shipping container may reduce an efficiency of transporting the items. For example, wasted space in the shipping container may cause additional trips to be made to transport a similar volume of items, may cause additional carbon emissions to be generated to transport the similar volume of items, and the like. Additionally, constructing the custom loading system with lumber or other single-use loading materials may cause excessive materials and time to be used to pack the items in the shipping container. Since the custom loading system is specific to a particular set of items, and since the materials used to construct the custom loading system are single-use, the materials may be thrown away or otherwise wasted after transporting the particular set of items. Throwing away the materials may increase carbon emissions, for example by increasing demand for the materials, which are produced using carbon emissions, and the like.

A modular loading system can reduce carbon emissions and can address other technical challenges associated with transporting a custom or otherwise unique set of items. For example, the modular loading system can be reusable. The modular loading system can be made of durable materials such as plastics, metals, and the like. Additionally, the modular loading system: (i) can be constructed in a first configuration for packing a first unique set of items in a first shipping container, (ii) can be used to transport the first unique set of items from a first location to a second location, (iii) can be reconfigured into a second configuration for packing a second unique set of items in a second shipping container, and the like. Reconfiguring the modular loading system may not involve throwing any materials away and may involve repositioning components, such as one or more locking bars, and the like, within the modular loading system. Reusing the modular loading system can reduce carbon emissions generated with respect to producing materials for packing the items in the shipping container.

Additionally, since the components, such as the locking bar and the like, of the modular loading system are adjustable, a volume of items that can be packed in the shipping container can be maximized using the modular loading system. By maximizing the volume of items that can be packed in the shipping container, an efficiency of transporting the items can be maximized. For example, fewer transport trips can be made to transport a similar volume of items compared to other packing techniques that do not use the modular loading system. And, since fewer transport trips are made to transport the items, carbon emissions are reduced by using the modular loading system.

The modular loading system may additionally reduce instances of damage to items transported via the shipping container. For example, the modular loading system, or any components thereof, can be adjusted to pack the items in the shipping container in a configuration that optimizes or enhances safety to the items. Additionally, hardware components, such as nails, screws, rivets, cut wood, and the like can be reduced with the modular loading system. The hardware components may damage fragile items, such as artwork, and reducing or obviating the use of the hardware components reduces a risk of damage to the items (i) while loading the items in the shipping container, (ii) while transporting the items from a first location to a second location, and the like.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a perspective view of an inside of a shipping container 100 with a modular loading system 102 according to one example of the present disclosure. The shipping container 100 may be positioned on a land transportation vehicle (e.g., a truck), on a water transportation vehicle (e.g., a ship), or the like. An inside of the shipping container 100 may be sized to receive the modular loading system 102 and/or other components. In some examples, the modular loading system 102 may include one or more sections 104. For example, and as illustrated, the modular loading system includes eight sections 104 such as a first section 104*a*, a second section 104*b*, and a third section 104*c*. In some examples, each section 104 may be similar or identical, may be different from one another, etc. Additionally or alternatively, each section 104 may be a modular loading system, or the modular loading system 102 may include two or more sections 104. Other suitable numbers (e.g., less than eight or more than eight) of sections 104 can be included in the modular loading system 102.

In some examples, the modular loading system 102 can be positioned in the shipping container 100 to facilitate loading one or more items 106 in the shipping container 100. The one or more items 106 may include fragile items, irregularly shape items, or any other suitable items that can be transported via the shipping container 100. The one or more items 106 may be produced or otherwise positioned in a first location, and an end user in a second location different than the first location may request the one or more items 106. The one or more items 106 may be packed in the shipping container 100 using the modular loading system 102 to transport the one or more items 106 from the first location to the second location. A configuration of the modular loading system 102 may be optimized or otherwise enhanced or adjusted to maximize a safety of the one or more items 106, a volume of the one or more items 106, or the like.

The modular loading system 102 can include one or more structural beams 108, one or more modular beams 110, and/or other suitable components for the modular loading system 102. As illustrated in FIG. 1, each section 104 of the modular loading system 102 may include one or more structural beams 108, one or more modular beams 110, and the like. As an example, the first section 104*a* can include structural beams 108*a-e*, modular beams 110*a-d*, and any other suitable components for facilitating packing items in the shipping container 100 via the modular loading system 102. In some examples, a structural beam may include a beam, rod, or other structural device that can provide structural integrity to (e.g., to support weight on behalf of) the modular loading system 102 or any component thereof. Additionally or alternatively, a modular beam may include a beam, rod, or other structural device that can be used to adjust a configuration of the modular loading system 102 or any component thereof. In one particular example, a set of structural beams can be positioned in the shipping container 100 to provide structural integrity for the modular loading system 102 and/or one or more items 106 to be loaded in the shipping container 100. Additionally, a set of modular beams can be coupled to the set of structural beams to facilitate adjustment of the modular loading system 102 to optimize or enhance loading the one or more items 106 in the shipping container 100.

The one or more structural beams 108 can be spaced apart from one another, and the one or more modular beams 110 can be spaced apart from one another. For example, and as illustrated in FIG. 1, the structural beams 108*a-e* are spaced laterally apart from one another. The structural beam 108*a* can be positioned in a first location, the structural beam 108*b* can be positioned laterally offset from the structural beam 108*b*, the structural beam 108*c* can be positioned laterally offset from the structural beams 108*a-b*, and so on. Additionally, the modular beams 110*a-d* can be positioned vertically offset from one another. As illustrated, the modular beam 110*a* can be positioned in a first location (e.g., adjacent to a top, interior surface of the shipping container 100), the modular beam 110*b* can be positioned vertically offset (e.g., lower than) from the modular beam 110*a*, the modular beam 110*c* can be positioned vertically offset (e.g., lower than) from the modular beams 110*a-b*, and so on. The structural beams 108 and the modular beams 110 can be otherwise positioned to facilitate packing the one or more items 106 in the shipping container 100.

The structural beams 108 can be arranged in a first direction, and the modular beams 110 can be arranged in a second direction. The first direction can be approximately vertical. For example, the first direction can extend in approximately a straight line from an upper, interior surface of the shipping container 100 to a lower, interior surface of the shipping container such that the first direction is approximately perpendicular to the upper, interior surface and the lower, interior surface. The second direction can be nonparallel to the first direction. In one such example, the second direction can be approximately horizontal and can extend from the structural beam 108*a* to the structural beam 108*e*, and the second direction can be approximately perpendicular to the structural beam 108*a* and the structural beam 108*e*.

In some examples, the modular loading system 102 can include one or more locking bars 112 that can facilitate packing the one or more items 106 in the shipping container 100. As illustrated in FIG. 1, locking bar 112*a* can be positioned with respect to the third section 104*c* of the modular loading system 102 to stabilize the modular loading system 102 and the one or more items 106. The locking bar 112*a* can be attached to one or more modular beams 110 of the third section 104*c* and of other suitable sections 104 or components of the modular loading system. In some examples, the one or more items 106 may be packed in the shipping container 100 to contact the locking bar 112*a* to stabilize the one or more items 106 in one or more directions such as the first direction, the second direction, a third direction approximately perpendicular to the first direction and the second direction, etc. Additionally or alternatively, the one or more items 106 may be stabilized using a strap 114 that can be positioned around the one or more items 106. The strap 114 may be made of metallic material, polymeric material, fabric material, or any other durable material, elastic material, or the like that can be used to stabilize the one or more items 106. In some examples, the strap 114 can be coupled to one or more modular beams 110 of one or more sections 104 of the modular loading system 102 to retain the one or more items 106 in a particular location in the shipping container 100 during loading and transport of the one or more items 106 via the shipping container 100.

A configuration of the modular loading system 102 may be optimized or otherwise adjusted to maximize a safety of the one or more items 106, a volume of the one or more items 106, or the like. For example, the locking bar 112*a* can be repositioned, such as by attaching the ends of the locking bar 112*a* to different locations along the one or more modular beams 110, to different modular beams, and the like, to maximize an available volume to position the one or more items 106, to stabilize the one or more items 106 in the shipping container 100, etc.

Figure 2:
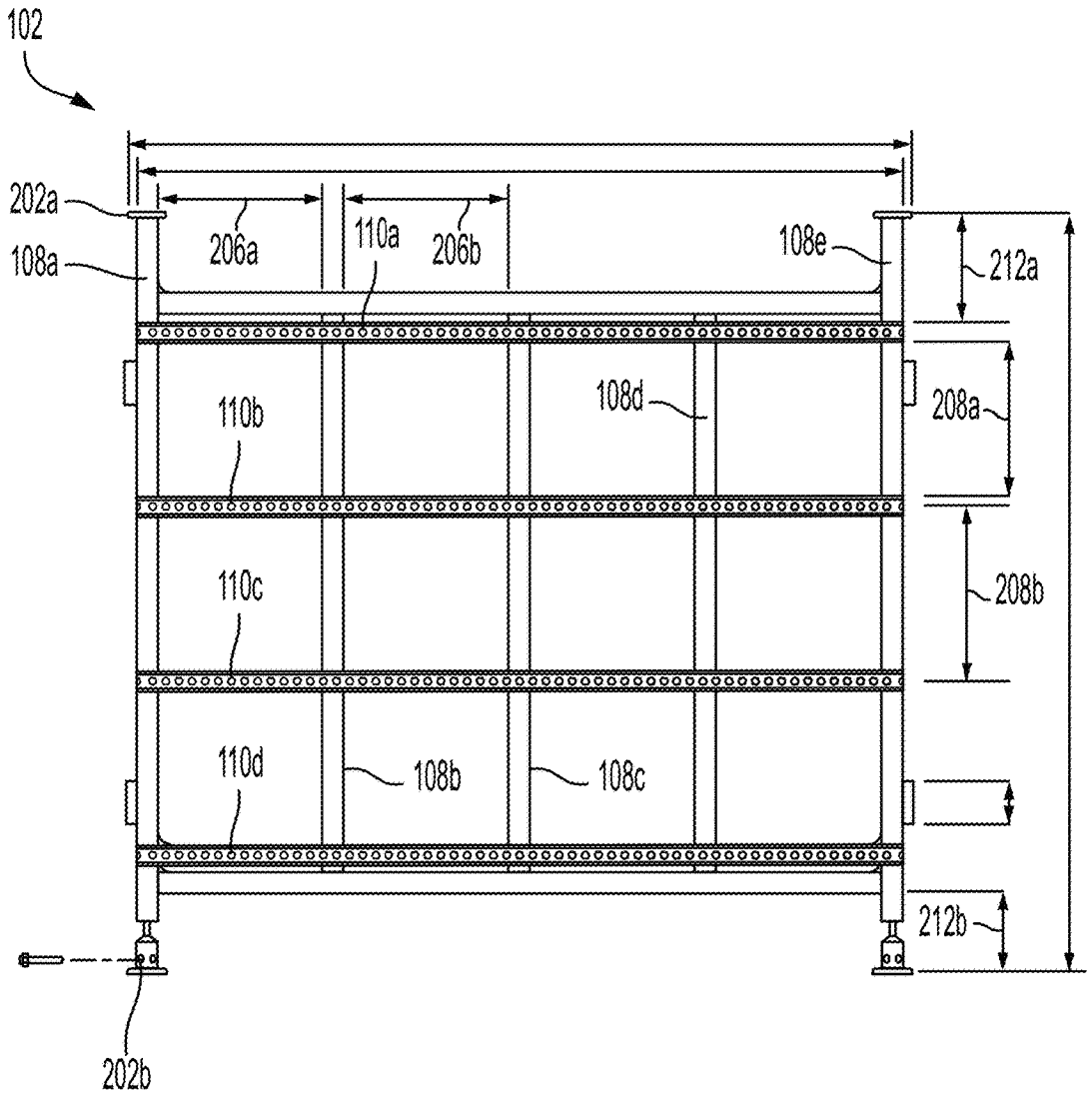
FIG. 2 is a side-view of a modular loading system for a shipping container according to one example of the present disclosure.

FIG. 2 is a side-view of a modular loading system 102 for a shipping container 100 according to one example of the present disclosure. As illustrated, the modular loading system 102 includes one section 104, but the modular loading system 102 can include more than one (e.g., two, three, four, etc.) section 104 for packing items in the shipping container 100. Additionally, the modular loading system 102 can include the structural beams 108*a-e* and the modular beams 110*a-d*. The modular loading system 102 can include any other suitable component for facilitating packing one or more items 106 in the shipping container 100.

The structural beams 108*a-e* can be arranged in the modular loading system 102 in the first direction, which may be approximately vertical, though in some examples, the first direction may be non-vertical. Each structural beam of the structural beams 108*a-e* may extend from at least the modular beam 110*a* to the modular beam 110*d*. In some examples, at least one structural beam (e.g., the structural beam 108*a*) of the structural beams 108*a-e* can extend from a first end of an interior surface of the shipping container 100 to a second end positioned opposite the first end of the interior of the shipping container 100.

For example, the structural beam 108*a* can include a first contact surface 202*a* and a second contact surface 202*b* that are positioned on opposite ends of the structural beam 108*a*. The first contact surface 202*a* can be positioned on a first end of the structural beam 108*a* to contact the first end of the interior of the shipping container 100, and the second contact surface 202*b* can be positioned on a second end opposite the first end of the structural beam 108*a* to contact the second end of the interior of the shipping container 100. The first contact surface 202*a* may include a fixed contact surface that may not be adjusted. For example, the fixed contact surface may have a fixed, non-adjustable length that is a predetermined distance from a closest modular beam 110. Additionally or alternatively, the second contact surface 202*b* may include an adjustable contact surface that can be adjusted. In some examples, the adjustable contact surface can be adjusted by rotating the adjustable contact surface, by adjusting hardware components (e.g., screws, bolts, latches, etc.) of the adjustable contact surface and/or the structural beam, by a jacking mechanism that can involve a screw jack or other similar component that can adjust the adjustable contact surface, or the like. Adjusting the adjustable contact surface can cause a length of the structural beam to increase or decrease. In some examples, adjusting the adjustable contact surface can additionally or alternatively cause a pressure applied by the structural beam to the interior surface (e.g., top and/or bottom, etc.) of the shipping container 100 to increase or decrease.

The structural beams 108*a-e* may be spaced apart from one another in the modular loading system 102. In some examples, the structural beams 108*a-e* can be equally spaced apart from one another, can have different distances between one another, or the like. As illustrated, the structural beam 108*a* is spaced laterally apart from the structural beam 108*b* by a first distance 206*a*, the structural beam 108*c* is spaced laterally apart from the structural beam 108*b* by a second distance 206*b*, and so on. The first distance 206*a* can be similar or identical to the second distance 206*b*, the first distance 206*a* can be different from the second distance 206*b*, etc. The spacing between the structural beams 108*a-e* may be optimized to optimize or enhance a stability of the modular loading system in a first direction following the path of one or more of the structural beams 108*a-e*, a second direction following the path of one or more of the modular beams 110*a-d*, and/or a third direction that can be approximately perpendicular to the first direction and/or the second direction.

The modular beams 110*a-d* may be spaced apart from one another and coupled to the structural beams 108*a-e* in the modular loading system 102. In some examples, the modular beams 110*a-d* can be equally spaced apart from one another, can have different distances between one another, or the like. As illustrated, the modular beam 110*a* is spaced vertically apart from the modular beam 110*b* by a first distance 208*a*, the modular beam 110*c* is spaced vertically apart from the modular beam 110*b* by a second distance 208*b*, and so on. The first distance 208*a* can be similar or identical to the second distance 208*b*, the first distance 208*a* can be different from the second distance 208*b*, etc. The spacing between the modular beams 110*a-d* may be optimized to optimize or enhance a stability of the modular loading system 102 in the first direction, the second direction, and/or the third direction.

The modular beams 110*a-d* can be mechanically coupled to the structural beams 108*a-e*, chemically coupled to the structural beams 108*a-e*, or the like. For example, each modular beam 110*a-d*, or any subset thereof, can be coupled to each structural beam of the structural beams 108*a-e* via one or more welds, one or more screws, rivets, bolts, etc., one or more adhesives, and the like. In one particular example, each modular beam of the modular beams 110*a-d* can be welded at multiple points to each structural beam of the structural beams 108*a-e* such that the modular beams 110*a-d* are vertically offset from one another and that each modular beam of the modular beams 110*a-d* is approximately perpendicular to a corresponding structural beam of the structural beams 108*a-e*.

The structural beams 108*a-e*, or any subset thereof, and/or the modular beams 110*a-d*, or any subset thereof, may be formed into a shape 210. The shape 210 can be three-dimensional and can have a cross-section of a square, a rectangle, a circle, a triangle, other regular shapes, other irregular shapes, or the like. As illustrated, the structural beams 108*a-e* are rods with a quadrilateral cross-section, though other suitable shapes are possible. Additionally or alternatively, a first structural beam of the structural beams 108*a-e* may have a different shape than a second structural beam of the structural beams 108*a-e*. In other examples, the shape 210 of each structural beam of the structural beams 108*a-e* may be similar or identical to the shape 210 of the other structural beams of the structural beams 108*a-e*.

The first contact surface 202*a* may be positioned a first distance 212*a* from the modular beam 110*a* or other closest modular beam, and the second contact surface 202*b* may be positioned a second distance 212*b* from the modular beam 110*d* or other closest modular beam. In some examples, the first distance 212*a* may be a fixed distance that does not change in response to adjusting a configuration of the modular loading system 102. Additionally or alternatively, the second distance 212*b* may be an adjustable distance that can change in response to adjusting a configuration of the modular loading system 102. For example, if a total height (e.g., from the first contact surface 202*a* to the second contact surface 202*b*) is less than an interior length of the shipping container 100, the second contact surface 202*b* can be adjusted to increase the total height. Accordingly, the second distance 212*b* can be increased to cause the first contact surface 202*a* and the second contact surface 202*b* to abut and apply pressure to respective interior surfaces of the shipping container 100.

Figure 3:
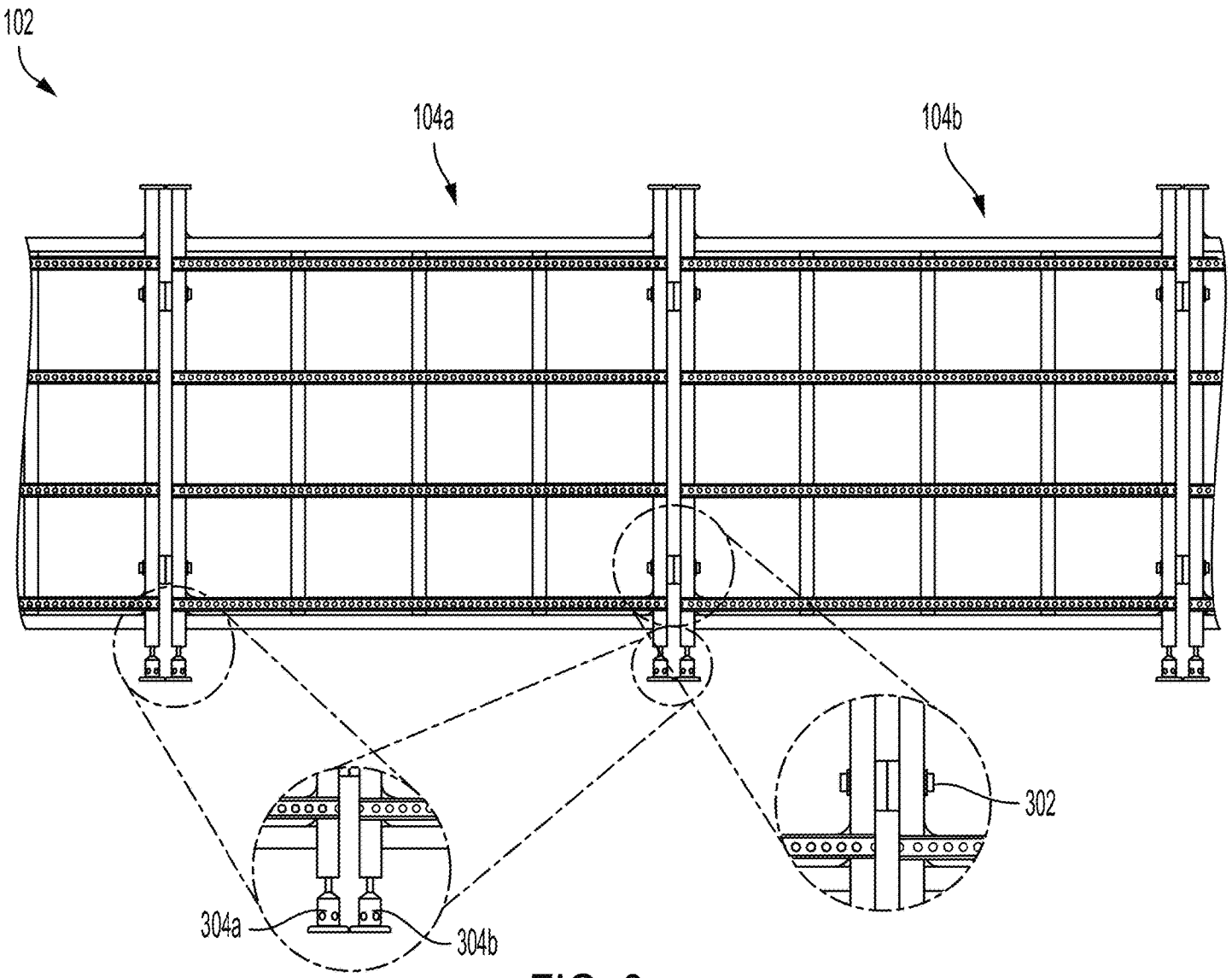
FIG. 3 is a side-view of a modular loading system for a shipping container according to one example of the present disclosure.

FIG. 3 is a side-view of a modular loading system 102 for a shipping container 100 according to one example of the present disclosure. As illustrated, the modular loading system 102 includes at least two sections: a first section 104*a* and a second section 104*b*. In some examples, the modular loading system 102 can include other suitable numbers (e.g., less than two or more than two) sections to facilitate packing the one or more items 106 in the shipping container 100.

The first section 104*a* (e.g., a first modular loading system) can be positioned in the shipping container 100, and the second section 104*b* (e.g., a second modular loading system) can be positioned in the shipping container 100 adjacent to and laterally offset from the first section 104*a*. The first section 104*a* may be mechanically coupled to the second section 104*b*, may be chemically coupled to the second section 104*b*, or the like. For example, and as illustrated, a clamp 302 can mechanically couple the first section 104*a* to the second section 104*b*. In some examples, the clamp 302 can be or include one or more nuts and one or more bolts that extend through the structural beam of the first section 104*a* and the structural beam of the second section 104*b*. The clamp 302 may simultaneously apply approximately equal and approximately opposite pressure on the first section 104*a* and the second section 104*b* to retain the first section 104*a* and the second section 104*b* a predetermined distance laterally spaced apart. One, or more than one, clamp 302 can be used to mechanically couple the first section 104*a* and the second section 104*b*. For example, and as illustrated in FIG. 3, two clamps 302 mechanically coupled the first section 104*a* and the second section 104*b*, though other suitable numbers (e.g., less than two or more than two) of clamps 302 can be used to mechanically couple the first section 104*a* and the second section 104*b*.

The first section 104*a* can include a first adjustable contact surface 304*a*, and the second section 104*b* can include a second adjustable contact surface 304*b*. The first adjustable contact surface 304*a* and the second adjustable contact surface 304*b* can be positioned on a common side with respect to an interior of the shipping container 100. For example, and as illustrated, the first adjustable contact surface 304*a* can be positioned on a first end (e.g., adjacent to a bottom, interior surface of the shipping container 100) of the first section 104*a*, and the second adjustable contact surface 304*b* can be positioned on a first end of the second section 104*b* corresponding to the first section 104*a*. The first adjustable contact surface 304*a* and the second adjustable contact surface 304*b* can be adjusted such that a relative height (e.g., within the shipping container 100) of each modular beam of the first section 104*a* is approximately the same as the relative height of each modular beam of the second section 104*b*.

Figure 4:
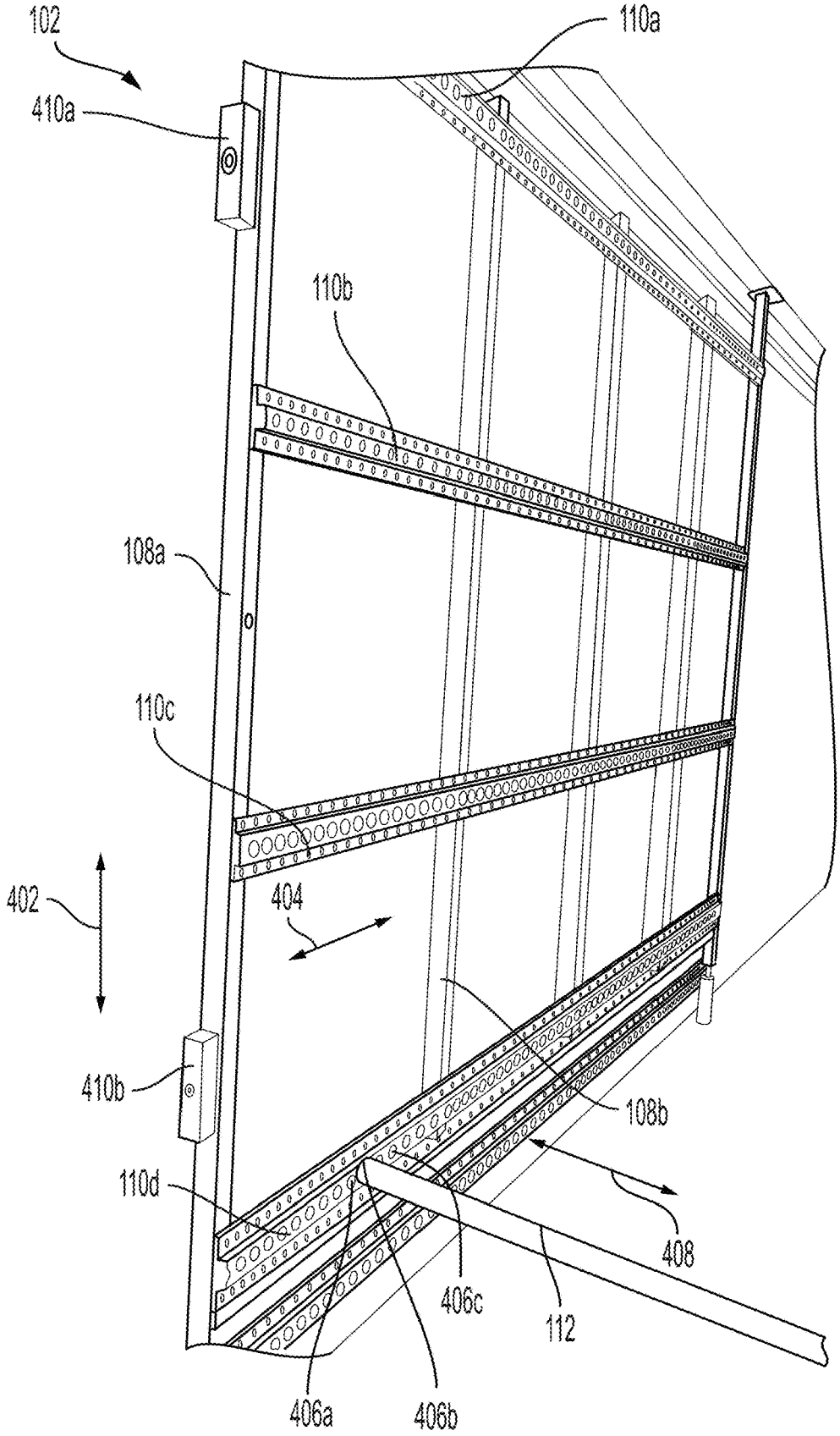
FIG. 4 is a diagram of a modular loading system installed in a shipping container according to one example of the present disclosure.

FIG. 4 is a diagram of a modular loading system 102 installed in a shipping container 100 according to one example of the present disclosure. The modular loading system 102 can include structural beams, such as the structural beams 108*a-b*, modular beams, such as the modular beams 110*a-d*, and latching bars 410*a-b*, which may facilitate coupling together of more than one modular loading system 102 or more than one section 104 of a modular loading system 102. The modular loading system 102 can include any other suitable numbers of structural beams, modular beams, and other components for facilitating packing the one or more items 106 in the shipping container 100. The structural beams 108*a-b* can be arranged in a first direction 402, and the modular beams 110*a-d* can be arranged in a second direction 404, which may be substantially perpendicular to the first direction 402. Additionally, the modular beams 110*a-d* may each be coupled to each of the structural beams 108*a-b* at multiple points.

Each modular beam of the modular beams 110*a-d*, or any subset thereof, may include receiving notches that can be sized to receive a locking bar 112. For example, and as illustrated in FIG. 4, the modular beam 110*d* can include a set of receiving notches including receiving notches 406*a-c*. Each receiving notch of the set of receiving notches can be laterally spaced apart, or otherwise suitably spaced apart, for allowing a position of the locking bar 112 to be adjusted to optimize or enhance a configuration of the modular loading system 102. For example, each receiving notch may be positioned on the respective modular beam and spaced apart by 0.25 cm (0.098 in), 0.50 cm (0.197 in), 1.00 cm (0.394 in), 2.00 cm (0.787), 4.00 cm (1.575 in), 8.00 cm (3.150 in), or further.

The modular loading system 102 can include one locking bar 112, two locking bars, three locking bars, or more than three locking bars. In some examples, the modular loading system 102 can include a number of locking bars to optimize or enhance a configuration of the modular loading system 102 such that a safety of the one or more items 106 and a volume available to pack the one or more items 106 are simultaneously maximized. The locking bar 112 can be positioned in one or more receiving notches of one or more of the modular beams 110*a-d* of the modular loading system 102. For example, and as illustrated in FIG. 4, a first end of the locking bar 112 is positioned in the receiving notch 406*b* of the modular beam 110*d*, though the first end of the locking bar 112 can be positioned in the receiving notch 406*a*, the receiving notch 406*c*, or any other suitable receiving notch for optimizing or enhancing the configuration of the modular loading system 102. Additionally, a second end opposite the first end of the locking bar 112 can be positioned in a different receiving notch of a different modular beam (e.g., that may be positioned on an opposite side of the interior of the shipping container 100 compared to the modular beam 110*d*. Thus, the locking bar 112 may extend in a third direction 408 from a first side of the interior of the shipping container 100 to a second side of the interior of the shipping container 100. In some examples, the third direction 408 may be substantially perpendicular to the first direction 402 and/or substantially perpendicular to the second direction 404.

Figure 5:
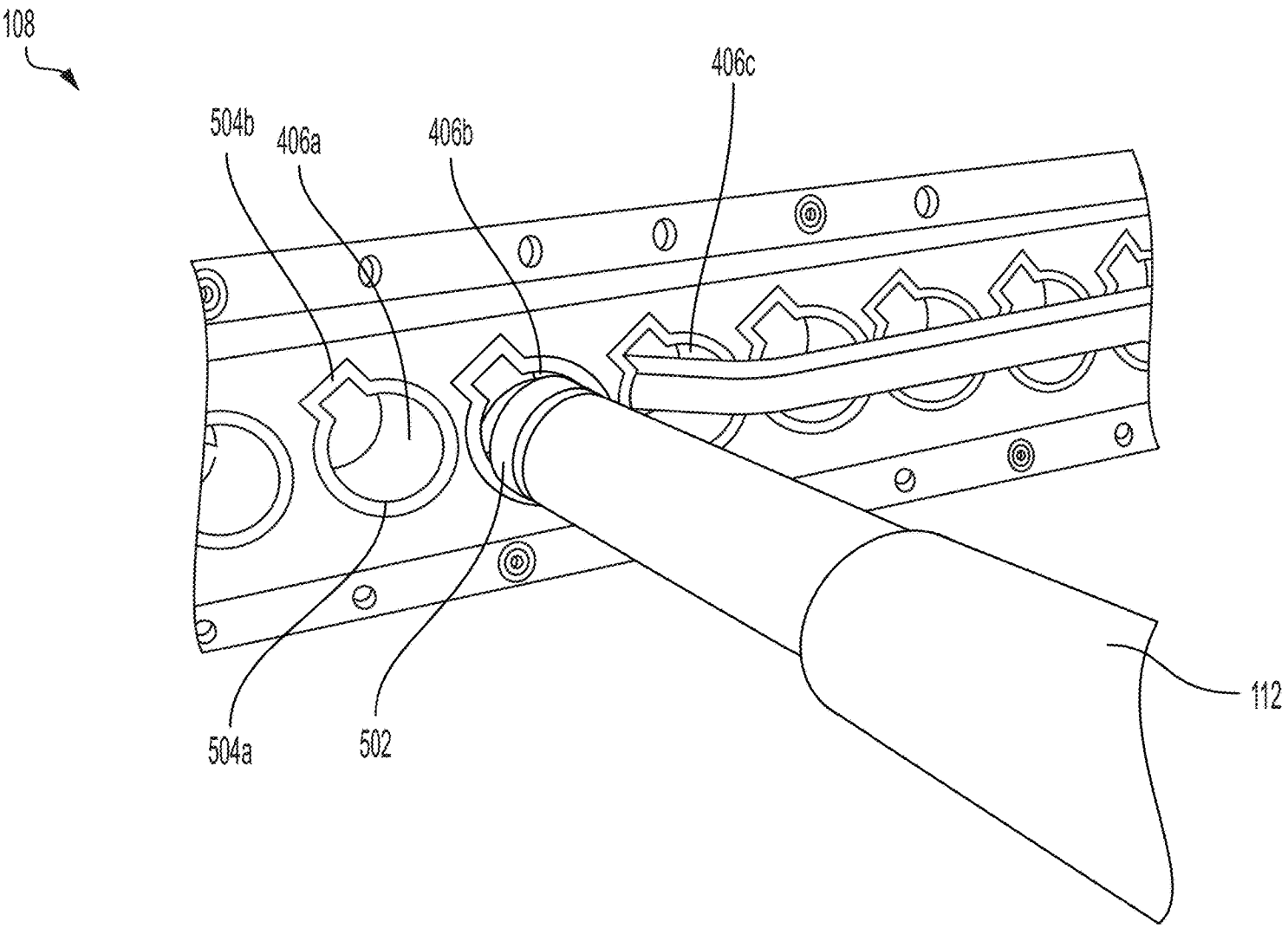
FIG. 5 is a diagram of a modular beam of a modular loading system for a shipping container according to one example of the present disclosure.

FIG. 5 is a diagram of a modular beam 110 of a modular loading system 102 for a shipping container 100 according to one example of the present disclosure. The modular beam 110 can include a set of receiving notches such as the receiving notches 406*a-c*. Additionally, a first end 502 of the locking bar 112 can be positioned in one or more receiving notches of the set of receiving notches of the modular beam 110. For example, and as illustrated, the first end 502 of the locking bar 112 can be positioned in the receiving notch 406*b*, though the first end 502, or any other end, of the locking bar 112 can be positioned in any other suitable receiving notch of the set of receiving notches of the modular beam 110.

Each receiving notch of the set of receiving notches can be sized to receive the first end 502 of the locking bar 112. For example, each receiving notch of the set of receiving notches can have a shape similar or identical to the shape of the first end 502 and may have a size that can be approximately the same as or larger than the size (e.g., a diameter, a width, etc.) of the first end 502. Additionally or alternatively, a lower portion 502*a* (e.g., a portion positioned closer to the ground than any other portion) of the receiving notch may extend away from the modular beam 110 further than an upper portion 502*b* of the receiving notch. In some examples, the lower portion 502*a* may extend further in the third direction 408 than the upper portion 502*b* to increase an ease of installing the locking bar 112 in the receiving notch.

Figure 6:
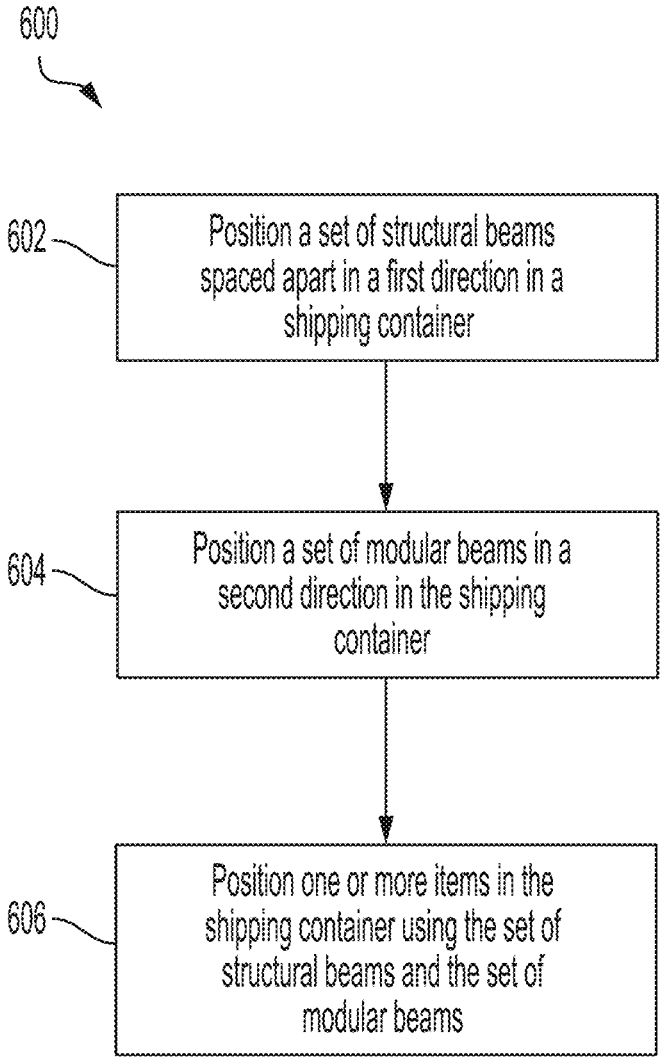
FIG. 6 is a flowchart of a process for installing and using a modular loading system for a shipping container according to one example of the present disclosure.

FIG. 6 is a flowchart of a process 600 for installing and using a modular loading system 102 for a shipping container 100 according to one example of the present disclosure. The process 600 is described as a set of operations, and each operation of the set of operations can be performed synchronously, asynchronously, and/or substantially contemporaneously. For example, two or more of the operations may be performed at the same time, may be performed in response to a separate operation being performed, or otherwise may be independently performed with or without respect to order. The operations of the process 600 are described with respect to the components, such as the modular loading system 102, described and illustrated with respect to FIGS. 1-5.

At block 602, a set of structural beams 108 are positioned in a shipping container 100. The structural beams 108 can include one, two, three, or more structural beams and can each be arranged spaced apart from one another and in a first direction. In some examples, the first direction may approximately follow a direction of gravity. Additionally or alternatively, a first end of each of the structural beams may be positioned adjacent to a first, interior surface of the shipping container 100, and a second end opposite the first end of each of the structural beams may be positioned adjacent to a second, interior surface opposite the first, interior surface of the shipping container 100.

At least one structural beam of the plurality of structural beams can include a fixed contact surface and an adjustable contact surface. The fixed contact surface can be positioned on a first end of the structural beam adjacent to the first, interior surface of the shipping container 100, and the adjustable contact surface can be positioned on a second end opposite the first end of the structural beam adjacent to the second, interior surface of the shipping container 100. Subsequent to positioning the structural beams in the shipping container 100, the adjustable contact surface can be adjusted to increase or decrease the pressure applied from the structural beam on the interior surfaces of the shipping container 100.

At block 604, a set of modular beams 110 are positioned in the shipping container 100. The modular beams 110 can include one, two, three, or more modular beams and can each be arranged spaced apart from one another and in a second direction. In some examples, the first direction may be approximately perpendicular to the first direction and may be substantially perpendicular to the direction of gravity. Each modular beam of the modular beams 110 can be coupled (e.g., mechanically, chemically, etc.) to each structural beam of the structural beams 108. Additionally, each modular beam may include a set of receiving notches. Each receiving notch of the set of receiving notches can be sized to receive a locking bar 112 that can stabilize the modular loading system 102 in a third direction that is approximately perpendicular to the first direction and the second direction.

The operations described in the block 602 and in the block 604 can be performed simultaneously or otherwise substantially contemporaneously. For example, the modular beams 110 may be coupled, whether mechanically, chemically, or the like, to the structural beams 108 prior to positioning the structural beams 108 and the modular beams 110 in the shipping container 100. Additionally or alternatively, the adjustable contact surface may be adjusted prior to, during, or subsequent to positioning the structural beams 108 and/or the modular beams 110 in the shipping container 100.

At block 606, one or more items 106 are positioned in the shipping container 100 using the modular loading system 102. A configuration of the modular loading system 102 can be optimized or otherwise adjusted prior to or substantially contemporaneously with respect to positioning the one or more items 106 in the shipping container 100. For example, one or more locking bars 112 may be positioned in the modular loading system 102 via one or more of the modular beams to optimize a safety of the one or more items 106 while being transported via the shipping container 100, a volume available to load the one or more items 106 in the shipping container 100, an airflow between the one or more items 106 or otherwise throughout the shipping container 100, and the like. Upon (or while) optimizing or adjusting the configuration of the modular loading system 102, the one or more items 106 can be packed into the shipping container 100 using the modular loading system 102 and other packing and/or shipping materials such as straps, clamps, bolts, and the like.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A modular loading system comprising:

a plurality of structural beams positionable in a shipping container, the plurality of structural beams spaced apart and arranged in a first direction, wherein at least one structural beam of the plurality of structural beams comprises:

a fixed contact surface located on a first end of the at least one structural beam, the fixed contact surface arranged to make contact with an inside surface of the shipping container; and an adjustable contact surface located on a second end of the at least one structural beam located opposite the first end, the fixed contact surface and the adjustable contact surface configured to apply pressure to the inside surface of the shipping container to stabilize the modular loading system in approximately the first direction, wherein the pressure is appliable to the inside surface by the fixed contact surface based on the contact between the inside surface and the fixed contact surface; and a plurality of modular beams spaced apart and arranged in a second direction that is nonparallel to the first direction, each modular beam of the plurality of modular beams coupled with each structural beam of the plurality of structural beams at one or more connection points, wherein each modular beam of the plurality of modular beams comprises a plurality of receiving notches, each receiving notch of the plurality of receiving notches is sized to receive a locking bar that is configured to stabilize the modular loading system in a third direction that is approximately perpendicular to the first direction and the second direction.

2. The modular loading system of claim 1, wherein the at least one structural beam of the plurality of structural beams extends from a first, interior end of the shipping container to a second, interior end of the shipping container, wherein the first, interior end is located opposite the second, interior end, wherein the fixed contact surface abuts the first, interior end of the shipping container, and wherein the adjustable contact surface abuts the second, interior end of the shipping container.

3. The modular loading system of claim 2, wherein the adjustable contact surface is adjustable to control a pressure applied (i) from the fixed contact surface to the first, interior end of the shipping container, and (ii) from the adjustable contact surface to the second, interior end of the shipping container.

4. The modular loading system of claim 2, wherein the plurality of structural beams includes one or more structural beams that are different than the at least one structural beam, wherein each structural beam of the one or more structural beams extends from a first modular beam of the plurality of modular beams to a second modular beam of the plurality of modular beams, and wherein each structural beam of the one or more structural beams contacts each modular beam of the plurality of modular beams.

5. The modular loading system of claim 1, further comprising one or more latching bars located on at least one structural beam of the plurality of structural beams, wherein the plurality of structural beams is a first plurality of structural beams included in a first section of the modular loading system, wherein the plurality of modular beams is a first plurality of modular beams included in the first section, and wherein the modular loading system further comprises a second section coupled to the first section via the one or more latching bars.

6. The modular loading system of claim 5, wherein the second section comprises:

a second plurality of structural beams positionable in the shipping container, the second plurality of structural beams spaced apart and arranged in approximately the first direction, wherein at least one structural beam of the second plurality of structural beams comprises:

a second fixed contact surface located on a first end of the at least one structural beam of the second plurality of structural beams; and a second adjustable contact surface located on a second end of the at least one structural beam located opposite the first end, the second fixed contact surface and the second adjustable contact surface configured to apply pressure to the inside surface of the shipping container to stabilize the modular loading system in approximately the first direction; and a second plurality of modular beams spaced apart and arranged in approximately the second direction, each modular beam of the second plurality of modular beams coupled with each structural beam of the second plurality of structural beams at one or more connection points, wherein each modular beam of the second plurality of modular beams comprises:

a second plurality of receiving notches, each receiving notch of the second plurality of receiving notches sized to receive a second locking bar that is configured to stabilize the modular loading system in approximately a third direction; and wherein a first height of each modular beam of the first plurality of modular beams with respect to a floor of the shipping container is approximately equal to a second height of a corresponding modular beam of the second plurality of modular beams.

7. A system comprising:

a shipping container; and a modular loading system positionable in the shipping container and removable from the shipping container, the modular loading system comprising:

a plurality of structural beams positionable in the shipping container, the plurality of structural beams spaced apart and arranged in a first direction, wherein at least one structural beam of the plurality of structural beams comprises:

a fixed contact surface located on a first end of the at least one structural beam, the fixed contact surface arranged to make contact with an inside surface of the shipping container; and an adjustable contact surface located on a second end of the at least one structural beam located opposite the first end, the fixed contact surface and the adjustable contact surface configured to apply pressure to an inside surface of the shipping container to stabilize the modular loading system in approximately the first direction, the adjustable contact surface usable to install the modular loading system in non-uniform spacing of the shipping container to enhance one or more parameters comprising an arrangement of items in the shipping container, wherein the pressure is appliable to the inside surface by the fixed contact surface based on the contact between the inside surface and the fixed contact surface; and a plurality of modular beams spaced apart and arranged in a second direction that is nonparallel to the first direction, each modular beam of the plurality of modular beams coupled with each structural beam of the plurality of structural beams at one or more connection points, wherein each modular beam of the plurality of modular beams comprises:

a plurality of receiving notches, each receiving notch of the plurality of receiving notches sized to receive a locking bar that is configured to stabilize the modular loading system in a third direction that is approximately perpendicular to the first direction and the second direction, the locking bar repositionable within the modular loading system for enhancing the one or more parameters.

8. The system of claim 7, wherein the one or more parameters comprise (i) a volume of items in the shipping container, (ii) a mechanical security of restrained items in the shipping container, (iii) a location of items in the shipping container, and (iv) a balance of the shipping container when loaded, and wherein the at least one structural beam of the plurality of structural beams extends from a first, interior end of the shipping container to a second, interior end of the shipping container, wherein the first, interior end is located opposite the second, interior end, wherein the fixed contact surface abuts the first, interior end of the shipping container, and wherein the adjustable contact surface abuts the second, interior end of the shipping container.

9. The system of claim 8, wherein the adjustable contact surface is adjustable to control a pressure applied (i) from the fixed contact surface to the first, interior end of the shipping container, and (ii) from the adjustable contact surface to the second, interior end of the shipping container, and wherein the adjustable contact surface and the fixed contact surface are arrangeable prior to or substantially contemporaneous with installing in the shipping container to conform to an interior dimension of the shipping container.

10. The system of claim 8, wherein the plurality of structural beams includes one or more structural beams that are different than the at least one structural beam, wherein each structural beam of the one or more structural beams extends from a first modular beam of the plurality of modular beams to a second modular beam of the plurality of modular beams, and wherein each structural beam of the one or more structural beams contacts each modular beam of the plurality of modular beams.

11. The system of claim 7, wherein the modular loading system further comprises one or more latching bars located on at least one structural beam of the plurality of structural beams, wherein the plurality of structural beams is a first plurality of structural beams included in a first section of the modular loading system, wherein the plurality of modular beams is a first plurality of modular beams included in the first section, and wherein the modular loading system further comprises a second section coupled to the first section via the one or more latching bars.

12. The system of claim 11, wherein the second section comprises:

a second plurality of structural beams positionable in the shipping container, the second plurality of structural beams spaced apart and arranged in approximately the first direction, wherein at least one structural beam of the second plurality of structural beams comprises:

a second fixed contact surface located on a first end of the at least one structural beam of the second plurality of structural beams; and a second adjustable contact surface located on a second end of the at least one structural beam located opposite the first end, the second fixed contact surface and the second adjustable contact surface configured to apply pressure to the inside surface of the shipping container to stabilize the modular loading system in approximately the first direction; and a second plurality of modular beams spaced apart and arranged in approximately the second direction, each modular beam of the second plurality of modular beams coupled with each structural beam of the second plurality of structural beams at one or more connection points, wherein each modular beam of the second plurality of modular beams comprises:

a second plurality of receiving notches, each receiving notch of the second plurality of receiving notches sized to receive a second locking bar that is configured to stabilize the modular loading system in approximately the third direction.

13. The system of claim 12, wherein a first height of each modular beam of the first plurality of modular beams with respect to a floor of the shipping container is approximately equal to a second height of a corresponding modular beam of the second plurality of modular beams.

14. A system comprising:

a first modular loading system comprising:

a first plurality of structural beams positionable in a shipping container, the first plurality of structural beams spaced apart and arranged in a first direction, wherein at least one structural beam of the first plurality of structural beams comprises:

a first fixed contact surface located on a first end of the at least one structural beam of the first plurality of structural beams, the first fixed contact surface arranged to make contact with an inside surface of the shipping container; and a first adjustable contact surface located on a second end of the at least one structural beam located opposite the first end, the first fixed contact surface and the first adjustable contact surface configured to apply pressure to an inside surface of the shipping container to stabilize the first modular loading system in approximately the first direction, wherein the pressure is appliable to the inside surface by the first fixed contact surface based on the contact between the inside surface and the first fixed contact surface; and a first plurality of modular beams spaced apart and arranged in a second direction that is nonparallel to the first direction, each modular beam of the first plurality of modular beams coupled with each structural beam of the first plurality of structural beams at one or more connection points, wherein each modular beam of the first plurality of modular beams comprises:

a first plurality of receiving notches, each receiving notch of the first plurality of receiving notches sized to receive a first locking bar that is configured to stabilize the first modular loading system in a third direction that is approximately perpendicular to the first direction and the second direction; and a second modular loading system comprising:

a second plurality of structural beams positionable in the shipping container, the second plurality of structural beams spaced apart and arranged in approximately the first direction, wherein at least one structural beam of the second plurality of structural beams comprises:

a second fixed contact surface located on a first end of the at least one structural beam of the second plurality of structural beams; and a second adjustable contact surface located on a second end of the at least one structural beam positioned opposite the first end, the second fixed contact surface and the second adjustable contact surface configured to apply pressure to the inside surface of the shipping container to stabilize the second modular loading system in approximately the first direction; and a second plurality of modular beams spaced apart and arranged in approximately the second direction, each modular beam of the second plurality of modular beams coupled with each structural beam of the second plurality of structural beams at one or more connection points, wherein each modular beam of the second plurality of modular beams comprises:

a second plurality of receiving notches, each receiving notch of the second plurality of receiving notches sized to receive a second locking bar that is configured to stabilize the second modular loading system in approximately the third direction.

15. The system of claim 14, wherein:

the at least one structural beam of the first plurality of structural beams extends from a first, interior end of the shipping container to a second, interior end of the shipping container, wherein the first, interior end is positioned opposite the second, interior end, wherein the first fixed contact surface abuts the first, interior end of the shipping container, and wherein the first adjustable contact surface abuts the second, interior end of the shipping container; and the at least one structural beam of the second plurality of structural beams extends from the first, interior end of the shipping container to the second, interior end of the shipping container, wherein the second fixed contact surface abuts the first, interior end of the shipping container, and wherein the second adjustable contact surface abuts the second, interior end of the shipping container.

16. The system of claim 15, wherein the first adjustable contact surface and the second adjustable contact surface are each adjustable to control a pressure applied (i) from the first fixed contact surface or the second fixed contact surface, respectively, to the first, interior end of the shipping container, and (ii) from the first adjustable contact surface or the second adjustable contact surface, respectively, to the second, interior end of the shipping container.

17. The system of claim 15, wherein the first plurality of structural beams includes one or more first structural beams that are different than the at least one structural beam of the first plurality of structural beams, wherein each structural beam of the one or more first structural beams extends from a first modular beam of the first plurality of modular beams to a second modular beam of the first plurality of modular beams, and wherein each structural beam of the one or more first structural beams contacts each modular beam of the first plurality of modular beams.

18. The system of claim 15, wherein the second plurality of structural beams includes one or more second structural beams that are different than the at least one structural beam of the second plurality of structural beams, wherein each structural beam of the one or more second structural beams extends from a first modular beam of the second plurality of modular beams to a second modular beam of the second plurality of modular beams, and wherein each structural beam of the one or more second structural beams contacts each modular beam of the second plurality of modular beams.

19. The system of claim 14, wherein a first height of each modular beam of the first plurality of modular beams with respect to a floor of the shipping container is approximately equal to a second height of a corresponding modular beam of the second plurality of modular beams.

* * * * *